United States Patent [19]

Walter et al.

[11] 4,171,701

[45] Oct. 23, 1979

[54] TWEEZER

[75] Inventors: Henry J. Walter, Wilton; Eugene T. Fleischhauer, Stamford, both of Conn.

[73] Assignee: Clairol Incorporated, New York, N.Y.

[21] Appl. No.: 812,214

[22] Filed: Jul. 1, 1977

[51] Int. Cl.[2] ..... A61B 17/30; A61B 17/00

[52] U.S. Cl. ..... 128/354; 128/355

[58] Field of Search ..... 128/354, 355, 303.1

[56] References Cited

U.S. PATENT DOCUMENTS

| | | | |
|---|---|---|---|
| 979,697 | 12/1910 | Prankard | 128/354 |
| 1,785,919 | 12/1930 | Stickel | 128/354 |
| 1,991,816 | 2/1935 | Mosely | 128/355 |
| 1,998,219 | 1/1935 | Segal | 128/354 |
| 2,025,006 | 12/1935 | Ubelhart et al. | 128/355 |
| 2,082,263 | 6/1937 | Schleimer | 128/355 |
| 2,113,962 | 4/1938 | Moir | 128/354 |
| 2,123,870 | 7/1938 | Wehmer | 128/355 |
| 2,533,801 | 12/1950 | Helig | 128/354 |
| 2,592,484 | 4/1952 | Smith | 128/354 |
| 3,909,675 | 9/1975 | Hirsbrunner et al. | 317/41 |

FOREIGN PATENT DOCUMENTS

| | | | |
|---|---|---|---|
| 575804 | 4/1958 | Italy | 128/354 |

*Primary Examiner*—Lawrence W. Trapp

*Attorney, Agent, or Firm*—Gerald S. Rosen; George A. Mentis; David J. Mugford

[57] ABSTRACT

A tweezer useful for plucking hair comprising a housing; arms extending out of the housing and having jaws for grasping a hair to be plucked; first means for closing the arms around the hair until the hair is grasped between the jaws; second means for automatically retracting the arms into the housing after the hair has been grasped between the jaws; means mounted for movement along the housing, whereby a first movement thereof causes the first means to close the arms around and grasp the hair between the jaws, and a second movement thereof, in the same direction as the first movement, causes the second means to retract the arms into the housing, thereby plucking the hair; and means for automatically returning the arms to their unretracted and unclosed position.

27 Claims, 8 Drawing Figures

TWEEZER

BACKGROUND OF THE INVENTION

This invention relates to depilatators or tweezers useful for removing hair. More particularly, it relates to tweezers which remove hair by a manually controlled selection and grasping of the unwanted hair and then an automatic plucking thereof in response to manual actuation of the automatic plucking means.

Hair on the human body grows to a certain length and then either falls out, is cut, or is removed. Various methods are known for removing unwanted body hair. For permanent removal, electrolysis is used for destroying the root of the hair. For temporary removal of hair from large areas of the body, shaving or treatment by chemical depilatories is known. In the case of removal of a limited number of hairs from smaller areas of the body, such as the eyebrows, or of isolated facial hairs, plucking or pulling the hair out of the body dermis is generally employed. Plucking will keep the spot from which the hair is removed free from new hair growth for about one to six months, depending on whether the dermis is in a resting or growing state.

However, plucking cam be a sometimes unsuccessful, painful, and tedious operation because each hair root resists hair removal and is surrounded by a sensory nerve ending. It has been found that if hair is plucked at a speed in excess of about 100 ft./min., the reaction time of the sensory nerve is exceeded and essentially no pain is felt, which is recognized by those who attempt to pluck unwanted hair with as rapid a plucking motion as possible. But, as it is necessary to maintain a firm grasp on the hair while performing this rapid motion, only few attempts are successful at performing both these required actions.

Thus, a first objective to be satisfied by an efficient tweezer is that it be capable of being easily controlled by the user for initially selecting the hair to be removed and grasping the hair. In this regard, the tweezer should be easily manipulable to facilitate location of the unwanted hair and to position the tweezer hair removing means around the hair. Second, it should be capable of maintaining a firm hold on the hair prior to the removal operation, during which time the tweezer is being manipulated for that operation, and during the removal operation itself. Third, it should be capable of plucking the hair at a rapid speed.

Tweezers having two biased pincer arms, such as the tweezers shown in U.S. Pat. No. 1,286,673, and others of a similar, generally well known construction are fairly easily controlled by the user to select and grasp a hair, but are not capable of removing the hair any faster than the user can accomplish the above-described manual plucking motion. U.S. Pat. Nos. 979,697; 1,036,725; 1,714,822; 1,785,919; and 1,988,219 disclose tweezers having springs or similar means for rapidly retracting pincer arms grasping an unwanted hair, but these tweezers are not easily manipulated. Similarly, U.S. Pat. Nos. 1,991,816; 2,025,006; 2,082,263; 2,113,962; 2,123,870; and 2,592,484 disclose tweezers having various types of automatic means for rapidly plucking a hair, but these tweezers do not appear to provide the user with the capabilities of manually controlling the selection and grasping of the hair and of then automatically removing the hair, as do the tweezers of this invention.

The tweezers of this invention are an improvement over the above-discussed tweezers because they are easily manipulable for grasping a hair as close to the skin line as possible and removing it at such a speed that the pain normally incurred in this type of hair removal operation is substantially eliminated.

SUMMARY OF THE INVENTION

A tweezer useful for plucking hair comprising a housing; arms extending out the housing, the arms having jaws for grasping a hair to be plucked; means for closing the arms around the hair, until the hair is grasped by the jaws; means for automatically retracting the arms into the housing from the position of the arms in which the jaws grasp the hair; means movably mounted on the housing for activating the means for closing the arms around the hair by movement of the movably mounted means a particular distance on the housing, whereby the arms are moved together to close the arms around a hair, and for activating the means for automatically retracting the arms into the housing by further movement of the movably mounted means to a predetermined position on the housing, whereby the hair is plucked and means for automatically returning the arms to their unretracted and unclosed position.

BRIEF DESCRIPTION OF THE DRAWINGS

For a thorough understanding of this invention, reference should be made to the following description taken in connection with the accompanying drawings, in which.

DETAILED DESCRIPTION OF THE INVENTION

As will become evident below, the basic operating principle of the tweezer shown in FIGS. 1-6 involves the above-discussed dual action. The tweezer is manipulable for first mechanically grasping a hair between the jaws of the tweezer arms and then for causing an automatic retraction of the tweezer arms, so that the hair is plucked at a rapid speed.

Figure 1:
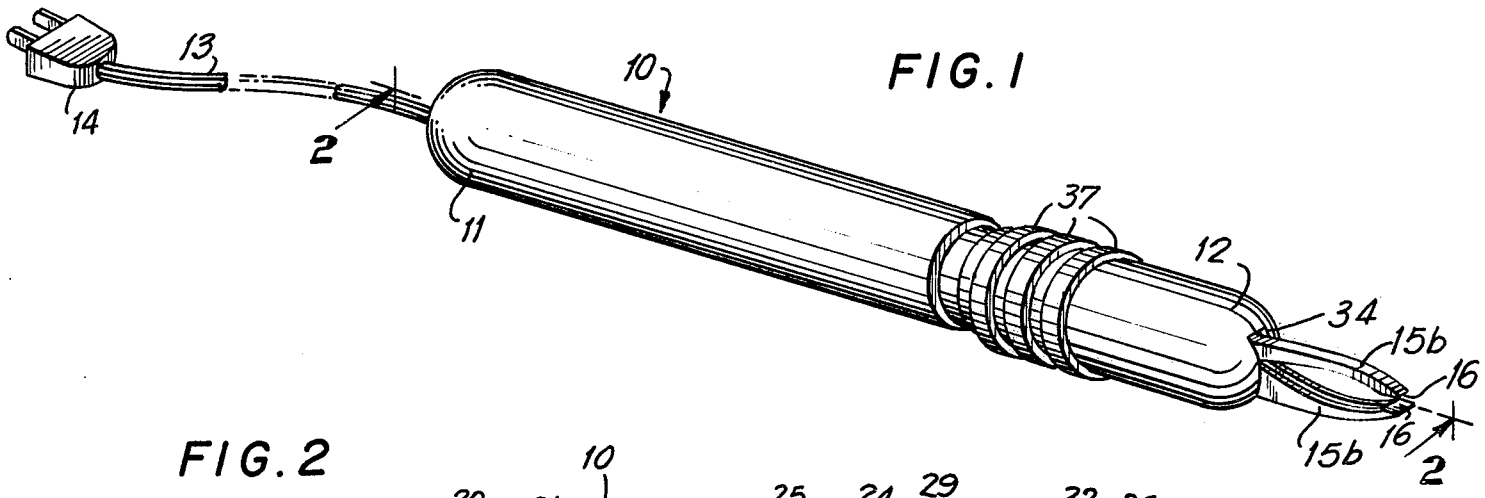
FIG. 1 is a perspective view, in elevation, of a tweezer of the present invention.

Referring to FIG. 1, the tweezer, generally indicated at 10, has a housing 11 and a sleeve 12 coaxially mounted on the housing 11. Protruding from the posterior end of housing 10 is an electric cord 13, with a plug 14 attached thereto, for delivering current into the tweezer from a power source (not shown). Protruding through the anterior ends of housing 11 and sleeve 12 and operationally connected to components of the tweezer within housing 11, which are described in detail below, are arms 15*a* and 15*b* having hair grasping jaws 16.

Figure 2:
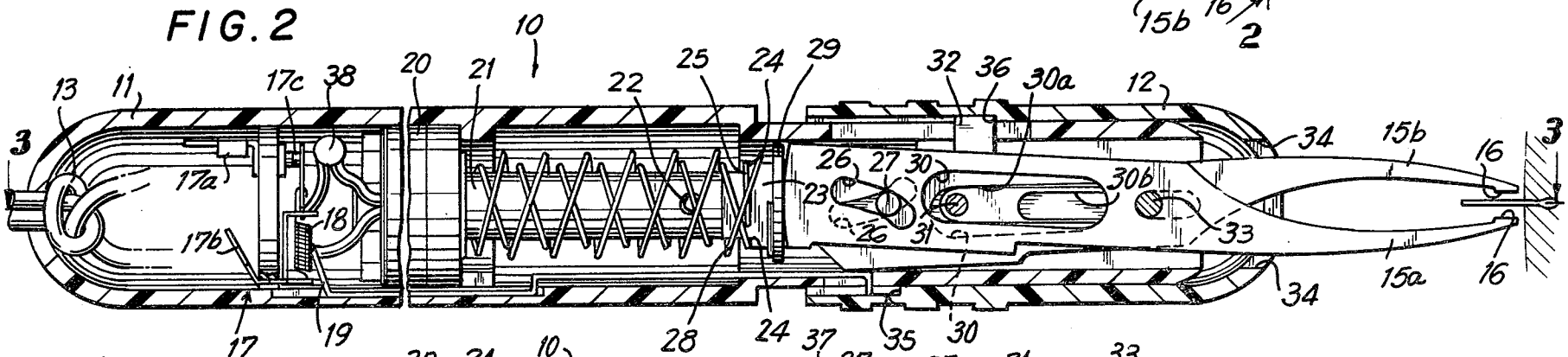
FIG. 2 is a cross-sectional view of the tweezer of FIG. 1 taken along lines 2—2 of FIG. 1.
Figure 3:
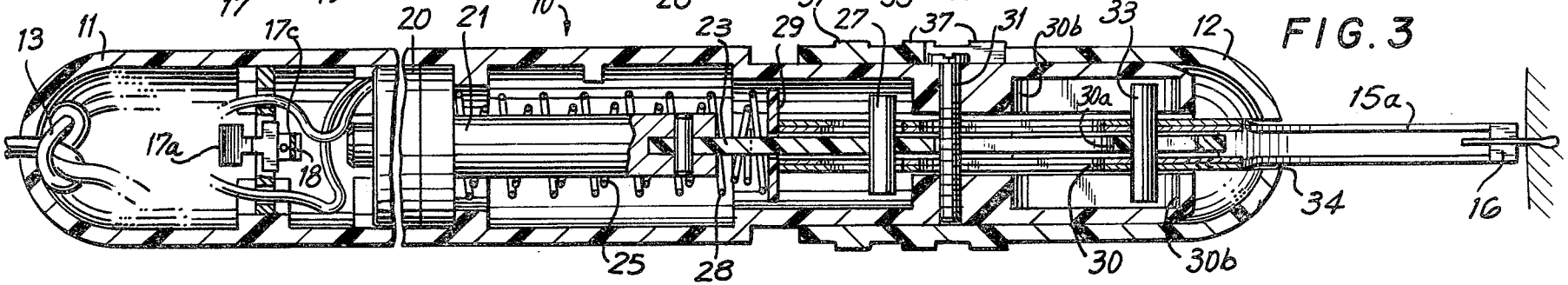
FIG. 3 is a cross-sectional view of the tweezer of FIG. 2 taken along lines 3—3 of FIG. 2.

With reference to FIGS. 2 and 3, it is apparent that the components of the tweezer contained within housing 10 are essentially in an axial and nesting arrangement to make the tweezer compact and easy to manipulate. Progressing forward from the posterior end of housing 10, cord 14 is interrupted by a switch 17, preferably one of the type shown which is generally known as an over center snap switch. Switch 17 includes electrical terminals and contacts 17*a* and *b*, contact arm 17*c*, a spring 18, and a control rod 19. This switch allows current to flow into the coil (not shown) of a solenoid 20 under the conditions described in detail below.

A plunger 21 extends outwardly from the anterior end of solenoid 20. Attached to the anterior end of plunger 21 by a roll pin 22 is an actuating plate or actuator 23, which is best seen in FIG. 3. Referring again to FIG. 2, actuator 23 has protrusions 24 on its posterior end against which one end of an actuating spring 25 is seated. In its partially compressed state, spring 25 urges actuator 23 away from solenoid 20 and its posterior end is seated on the housing of solenoid 20.

As best seen in FIG. 3, arm 15*a*, and also the other arm 15*b*, have essentially a double walled, U-shaped construction the walls of which surround actuator 23. Formed near the posterior end in each arm is a cam slot 26, the two cam slots being mirror images of each other, as best seen in FIG. 2. An actuating pin 27 is carried by actuator 23 and extends between the cam slots and through the arms. The arms are maintained in the position illustrated in FIG. 2 by a second spring 28, which in its partially compressed state abuts against a washer 29 that is seated on the extreme posterior ends of the arms, as best shown in FIG. 3. Springs 25 and 28 are coaxial and wound in opposite directions, which prevents their hang-up and tangling.

Provided in each arm anterior to slot 26 is a second slot 30. As shown best in FIG. 3, a screw 31 extends through slots 30 and into the walls of housing 11. A similar slot 30*a* is provided in actuator 23 and screw 31 also extends through this slot. In this embodiment of a tweezer of this invention, housing 11 is formed of two pieces, which are connected by screw 31.

Protruding out of the anterior portion of housing 11 approximately adjacent to screw 31 and connected to actuator 23 is a tab 32, which is best seen in FIG. 2. Anterior to slots 30 is a pivot pin 33, which is journalled through arms 15*a* and *b* to prevent horizontal movement of one arm relative to the other arm. Pivot pin 33 extends into the walls of housing 11 and to allow for its horizontal movement described below, slots 30*b* are provided in the housing walls.

Sleeve 12 surrounds the anterior portion of housing 11 and has an opening 34 through which arms 15*a* and *b* extend. The sleeve rides over the outer surface of housing 11 and has a first inwardly extending protrusion 35, which is positioned for abutment with the anterior end of control rod 19 when the tweezer is operated as described below, and a second inwardly extending protrusion 36 abutting tab 32, as best seen in FIG. 2. Additionally, various protrusions 37 extend outwardly from sleeve 12, which provides means for gripping the tweezer.

Prior to operation of the tweezer, jaws 16 are separated, as shown in FIG. 1. To pluck a hair, the jaws of the tweezer are positioned around the hair, which position is shown in FIGS. 2 and 3. To provide the separation between jaws 16, the arms are not parallel throughout their length with respect to each other in the horizontal direction, but rather the posterior end of one arm is higher than the posterior end of the other arm, as best shown in FIG. 2.

To grasp the hair, sleeve 12 is moved by the user in the posterior direction relative to housing 11 and jaws 16 are caused to close in the following manner. Sleeve 12's backward movement causes a similar movement of tab 32 abutting protrusion 36 on the sleeve and, consequently, actuator 23 is also moved backward. Spring 25 is compressed because of its abutment with protrusions 24 on actuator 23, but spring 28 prevents arms 15 from moving backward towards solenoid 20. Therefore, the movement of sleeve 12 described thusfar causes the actuator, but not the arms, to be moved towards solenoid 20. To close the jaws so that they grasp the hair, actuator pin 27 moving with the actuator rides in slots 26 of arms 15*a* and *b* and because pivot pin 33 prevents movement of one arm relative to the other, pin 27 causes the arms to pivot on pin 33. Thus, the posterior portions of the arms become parallel to each other, as shown in FIG. 4, and jaws 16 firmly grasp the hair around which they have been positioned.

The user has complete control over the selection and grasping of the hair to be plucked. In the event the hair is not correctly placed between the jaws of the tweezer or a firm grip on the hair is not obtained, the user can release the sleeve and repeat this process, without the tweezer having been activated to automatically attempt a plucking of the hair. In other words, the user has the perogative to continue or discontinue the plucking operation.

To pluck the hair, sleeve 12 is moved further backward in the posterior direction relative to housing 11. This continued movement of sleeve 12 activates electromechanical elements of the tweezer, so that it automatically plucks the hair in the following manner.

Figures 4, 5, 6, 7, 8:
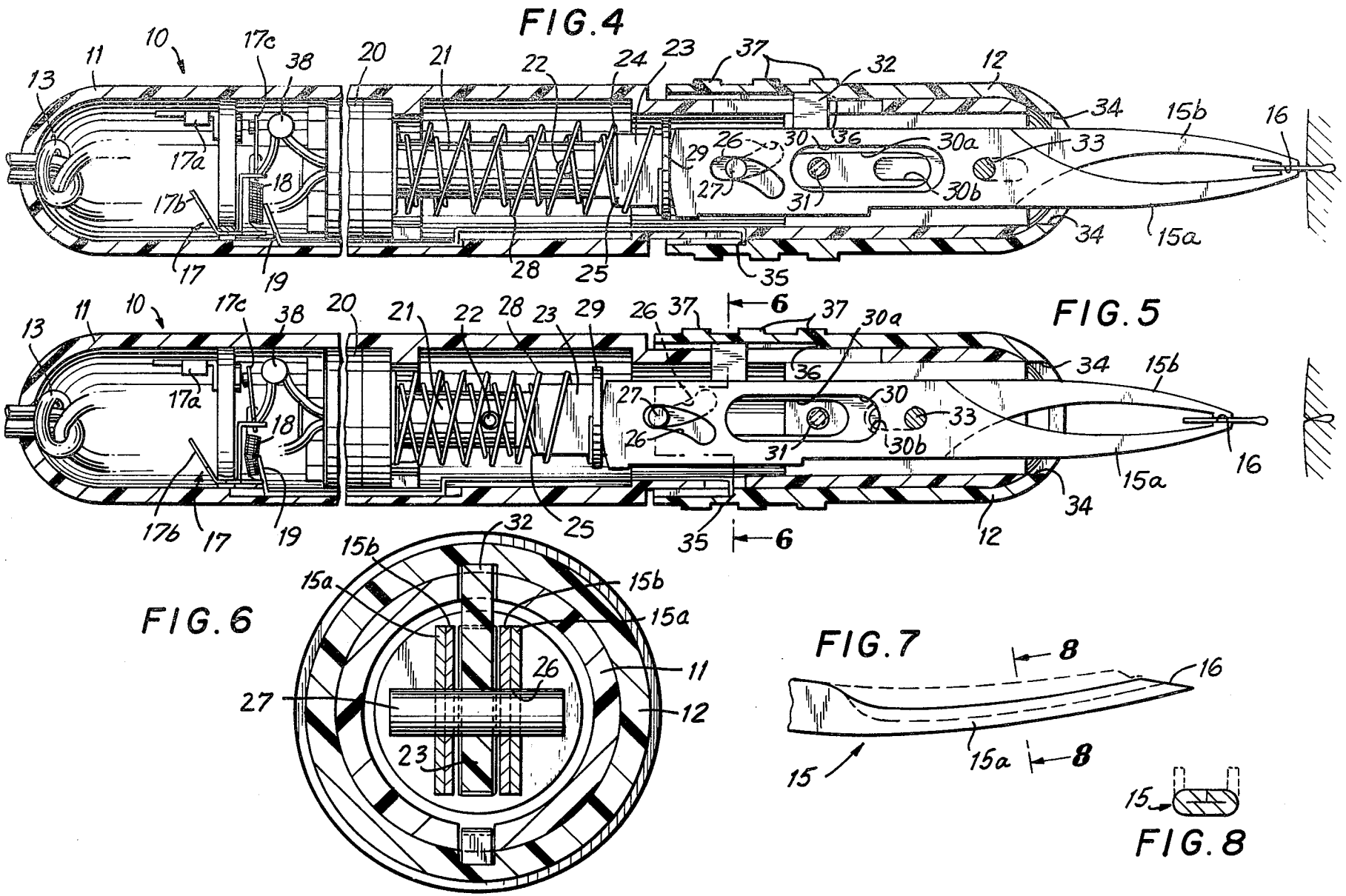
FIG. 4 is a view similar to FIG. 2 showing the jaws of the tweezer grasping a hair to be plucked.
FIG. 5 is a view similar to FIG. 4 showing the arms of the tweezer in a retracted position after the hair has been plucked.
FIG. 6 is a horizontal, cross-sectional view of the tweezer of FIG. 5 taken along lines 6—6 of FIG. 5.
FIG. 7 is a cutaway view of an alternative embodiment of a tweezer arm useful in the tweezers of this invention.
FIG. 8 is a cross-sectional view of the tweezer arm of FIG. 7 taken along lines 8—8 of FIG. 7.

As shown in FIG. 5, protrusion 35 on sleeve 12 contacts the anterior end of control rod 19, which pushes the rod out of its normally inactive condition and moves it backward, so that its upstanding posterior end contacts spring 18 of switch 17. Characteristic of such a switch, this contact with spring 18 causes contact arm 17*c* of the switch to toggle and close the switch, thereby allowing current flow through the coil of solenoid 20 and creating a magnetic field in the solenoid.

Plunger 21 of solenoid 20 is drawn into the magnetic field along with actuator 23 attached to the plunger. Actuator pin 27 continues to ride along the cam surfaces of slots 26, increasing clamping force on the hair held between jaws 16. Further movement of the actuator carries both tweezer arms 15*a* and *b* towards solenoid 20 and causes the hair to be extracted, until solenoid plunger 21 is seated in solenoid 20, as shown in FIG. 5.

To deactivate solenoid 20, separate jaws 16, and release the plucked hair, sleeve 12 is released by the user. Control rod 19 moves forward because spring 18 returns it to it's initial position and switch 20 is opened, thereby preventing current flow to solenoid 20. Because of the consequent elimination of the magnetic field in solenoid 20, plunger 21, actuator 23 attached thereto, and arms 15*a* and *b* are now moved forward in the housing by springs 25 and 28 to their initial positions shown in FIGS. 1–3. Because both springs were initially compressed in the plucking operation, they are now free to resume their initial, partially compressed state.

It should be understood from the above that once sleeve 12 is manipulated to activate solenoid 20, the retraction of arms 15*a* and *b* and the plucking of the hair occurs so rapidly that the pain normally incurred in hair plucking is substantially eliminated. Unlike the hair grasping portion of the plucking operation, which is under the manual control of the tweezer user, the retraction of the arms and actual removal of the hair occurs automatically once solenoid 20 is activated.

However, it is contemplated that an automatic means could be substituted for the mechanical hair grasping means described above without departing from the spirit of the invention; provided the automatic means could be operated by the tweezer user to allow for control over the selection and grasping of the hair to be removed in the same manner as does the mechanical grasping means described above. For example, the sleeve could be manually manipulated to activate electromechanical elements, such as the solenoid-plunger-activator described above, and thereby cause an incremental or slow, stoppable closing of the jaws of the tweezer arms. It is contemplated that closing and opening of the jaws around a hair would then be dependent upon and controlled by activation or deactivation of the electromechanical elements.

Preferably, the solenoid useful in a tweezer of this invention will be an intermittent duty, rather than a continuous acting, solenoid and it will employ means located somewhere in the circuit for preventing its overheating and burn-out, which could occur if the user closes the switch for an extended time. Such means may be a thermal protector wound into the coil of the solenoid, which would interrupt the current flow through the solenoid at a predetermined temperature, a switch, which activates or deactivates part of the coil when the plunger is seated, or a posistor.

Posistors disclosed in the publication entitled "Posistor PTH 60 Series For Circuit Protection", which is distributed by the Murata Corporation of America, Rock Mart, Ga., are useful in the tweezers of this invention. A posistor having the following electrical characteristics has been found to be particularly useful in combination with the particular solenoid described above.

| | |
|---|---|
| Resistance | 22 Ohms ± 20% |
| Max. Voltage | 125 Volts |
| Max. Current | 0.8 Amps. |
| Protective Threshold Current | |
| +25 C. | 230 Milli. Amps. ±20% |
| +60° C. | 150 Milli. Amps. (min.) |
| −10° C. | 320 Milli. Amps. (max.) |
| Operating Time | 10 Sec. max. over 0.8 amps. current |

The posistor indicated at 38 in FIG. 2, is placed in series with the solenoid and may be located anywhere in the circuit, the preferred location for the posistor being shown in FIG. 2. Its resistance value is chosen so that during normal operation of the tweezer the dissipation of the posistor does not raise its internal temperature appreciably. When energized for a prolonged period of time, it will heat up and its internal resistance will increase rapidly until it reaches at a predetermined temperature its switching or curie point. At this time, its internal resistance increases by many magnitudes, thereby limiting the current through the solenoid to a level where no damage to the solenoid coil will occur. Opening the circuit will let the posistor cool off rapidly, as it has low mass, and make the tweezer ready for operation again.

As a further alternative within the scope of this invention, the anterior portion of one or both of the tweezer arms can have a flattened construction formed by the upstanding walls of the arm or arms being folded over to the center line of the tweezer along the longitudinal axis of the tweezer, as shown in FIGS. 7 and 8. By folding over the upstanding walls of the tweezer arms, the arms are reinforced.

The above description of this invention is directed to preferred embodiments of these tweezers and should not be interpreted as defining the scope of the invention, which is accomplished by the claims appended hereto.

What is claimed is:

1. A tweezer useful for plucking hair comprising: a housing;

arms extending out of the housing, the arms having jaws for grasping a hair to be plucked;

means for closing the arms around the hair, until the hair is grasped by the jaws;

means for automatically retracting the arms into the housing from the position of the arms in which the jaws grasp the hair;

means movably mounted on the housing:

(a) for activating the means for closing the arms around the hair by movement of the means movably mounted a particular distance on the housing, whereby the arms are moved together to close the arms around a hair, and (b) for activating the means for automatically retracting the arms into the housing by further movement of the means movably mounted to a predetermined position on the housing, whereby the hair is plucked; and means for automatically returning the arms to their unretracted and unclosed position.

2. The tweezer of claim 1 wherein the means movably mounted on the housing is mounted around the housing and is movable along the longitudinal axis of the housing.

3. The tweezer of claim 2 wherein the means movably mounted on the housing is a ring.

4. The tweezer of claim 2 wherein the means movably mounted on the housing is a sleeve.

5. The tweezer of claim 1 wherein the means for closing the arms around the hair is substantially disposed within the housing, comprises a first element a portion of which extends out of the housing, and is activated by contact of the means movably mounted with the outwardly extending portion of the first element as the means movably mounted is moved on the housing.

6. The tweezer of claim 5 wherein the means for automatically retracting the arms into the housing is substantially disposed within the housing.

7. The tweezer of claim 1 wherein the means for automatically retracting the arms into the housing is substantially disposed within the housing, comprises a second element a portion of which extends out of the housing, and is activated by contact of the means movably mounted with the outwardly extending portion of the second element as the means movably mounted is moved on the housing.

8. The tweezer of claim 7 wherein: the second element is a control rod; and the means for retracting the arms into the housing further comprises means for delivering electrical current into the solenoid and a switch which in the closed position allows current flow into the solenoid whereby the control rod closes the switch to allow current flow into the solenoid from the means for delivering electrical current.

9. The tweezer of claim 5 wherein the means for automatically retracting the arms into the housing is substantially disposed within the housing, comprises a second element a portion of which extends out of the housing, and is activated by contact of the means movably mounted with the outwardly extending portion of the second element as the means movably mounted is moved along the housing.

10. The tweezer of claim 5 wherein the means for closing the arms around the hair further comprises: an actuator to which the first element is connected, the actuator being at least partially surrounded by each of the arms; a cam slot in a portion of each arm which surrounds the actuator, the cam slots being mirror images of each other; an actuator pin carried by the actuator projecting through the cam slots; and a pivot pin extending through the anterior portion of the actuator and a portion of each arm which surrounds the actuator to prevent horizontal movement of one arm relative to the other arm, so that as the means movably mounted is moved on the housing in contact with the first element, the actuator is moved in the same direction and the actuator pin rides along the cam slots causing the arms to close and the distance between the jaws to decrease until the hair is grasped between the jaws.

11. The tweezer of claim 7 wherein the means for automatically retracting the arms into the housing further comprises a solenoid and a plunger retractable into the solenoid upon the solenoid being activated, the plunger being connected to the arms by the actuator, so that as the means movably mounted is moved in contact with the second element to a predetermined position on the housing, the solenoid is activated, the plunger is retracted into the solenoid, and the arms are retracted, whereby the hair is plucked.

12. The tweezer of claim 8 wherein the means for retracting the arms into the housing further comprises a posistor.

13. The tweezer of claim 5 further comprising: a first spring, the first spring preventing retraction of the arms into the housing when the means for closing the arms around the hair is activated; and a second spring, the second spring being compressed when the means for closing the arms around the hair is activated.

14. The tweezer of claim 1 wherein the anterior portion of at least one of the arms has a flattened construction formed by folding two upstanding walls of the arm over to the center line of the arm along the longitudinal axis of the arm.

15. The tweezer of claim 1 wherein the means movably mounted has at least one outwardly extending protrusion, the protrusion providing a means for gripping the tweezer.

16. A tweezer useful for plucking hair comprising:

a housing;

arms extending out of the housing, the arms having jaws for grasping a hair to be plucked;

first means for closing the arms around the hair, until the hair is grasped between the jaws;

second means for automatically retracting the arms into the housing after the jaws grasp the hair;

third means mounted on the housing for movement parallel to the longitudinal axis of the housing, said first, second, and third means being arranged and constructed so that when the third means is moved to a first predetermined position on the longitudinal axis of the housing, the first means is activated whereby the hair is grasped between the jaws, and when the third means is moved to a second predetermined position on the longitudinal axis of the housing the second means is activated whereby the hair is plucked; and fourth means for automatically returning the arms to their unretracted and unclosed position.

17. The tweezer of claim 16 wherein said second means comprises a solenoid.

18. A tweezer useful for plucking hair comprising:

a housing;

arms extending out of the housing, the arms having jaws for grasping a hair to be plucked;

first means for closing the arms around the hair, until the hair is grasped between the jaws;

second means for automatically retracting the arms into the housing, after the hair has been grasped between the jaws;

third means movably mounted on the housing for activating the first means by movement of the third means to a first predetermined position on the housing, whereby the hair is grasped between the jaws, and for activating the second means by further movement in the same direction as the first movement to a second predetermined position on the housing, whereby the hair is plucked; and fourth means for automatically returning the arms to their unretracted and unclosed position.

19. The tweezer of claim 18 wherein said second means comprises a solenoid.

20. A tweezer useful for plucking hair comprising:

a housing;

arms extending out of the housing, the arms having jaws for grasping a hair to be plucked;

first means for closing the arms around the hair, until the hair is grasped between the jaws, said first means having a tab extending out of the housing;

second means for automatically retracting the arms into the housing after the jaws grasp the hair, said second means having a control rod extending out of the housing; and a sleeve movably mounted around the housing, whereby movement of the sleeve on the housing in contact with the tab causes the first means to close the arms around and grasp the hair between the jaws and further movement of the sleeve in the same direction in contact with the control rod causes the second means to pluck the hair.

21. The tweezer of claim 20 wherein the first means for closing the arms around the hair further comprises: an actuator to which the tab is integrally connected, the actuator being at least partially surrounded by each of the arms; a cam slot in a portion of each arm which surrounds the actuator, the cam slots being mirror images of each other; an actuator pin carried by the actuator projecting through the cam slots; and a pivot pin extending through the anterior portion of the actuator and a portion of each arm which surrounds the actuator to prevent horizontal movement of one arm relative to the other arm, so that as the sleeve is moved on the housing in contact with the tab, the actuator is moved in the same direction, and the actuator pin rides along the cam slots causing the arms to close and the distance between the jaws to decrease until the hair is grasped between the jaws.

22. The tweezer of claim 20 wherein the second means for automatically retracting the arms into the housing further comprises a solenoid and a plunger retractable into the solenoid upon the solenoid being activated, the plunger being connected to the arms by the actuator, so that as the sleeve is moved in contact with the outwardly extending portion of the control rod to a predetermined position on the housing, the solenoid is activated, the plunger is retracted into the solenoid, and the arms are retracted, whereby the hair is plucked.

23. The tweezer of claim 20 wherein the means for retracting the arms into the housing further comprises means for delivering electrical current into the solenoid and a switch which in the closed position allows current flow into the solenoid, whereby the control rod closes the switch to allow current flow into the solenoid from the means for delivering electrical current.

24. The tweezer of claim 23 wherein the means for retracting the arms into the housing further comprises a posistor.

25. The tweezer of claim 20 further comprising: a first spring, the first spring preventing retraction of the arms into the housing when the means for closing the arms around the hair is activated; and a second spring, the second spring being compressed when the means for closing the arms around the hair is activated.

26. The tweezer of claim 20 wherein the anterior portion of at least one of the arms has a flattened construction formed by folding two upstanding walls of the arm over to the center line of the arm along the longitudinal axis of the arm.

27. The tweezer of claim 20 wherein the sleeve has at least one outwardly extending protrusion, the protrusion providing a means for gripping the tweezer.

* * * * *